US009161394B2

(12) United States Patent
Carlsson et al.

(10) Patent No.: US 9,161,394 B2
(45) Date of Patent: Oct. 13, 2015

(54) MICROWAVE HEATING APPARATUS

(71) Applicant: Whirlpool Corporation, Benton Harbor, MI (US)

(72) Inventors: Hakan Carlsson, Norrkoping (SE); Olle Niklasson, Finspong (SE)

(73) Assignee: Whirlpool Corporation, Benton Harbor, MI (US)

( * ) Notice: Subject to any disclaimer, the term of this patent is extended or adjusted under 35 U.S.C. 154(b) by 193 days.

(21) Appl. No.: 13/784,926

(22) Filed: Mar. 5, 2013

(65) Prior Publication Data

US 2013/0228567 A1 Sep. 5, 2013

(30) Foreign Application Priority Data

Mar. 5, 2012 (EP) ..... 12158106

(51) Int. Cl.

| | |
|---|---|
| ***H05B 6/66*** | (2006.01) |
| ***H05B 6/50*** | (2006.01) |
| ***H05B 6/64*** | (2006.01) |
| ***H05B 6/70*** | (2006.01) |

(52) U.S. Cl.

CPC ..... *H05B 6/6447* (2013.01); *H05B 6/705* (2013.01)

(58) Field of Classification Search

CPC ..... H05B 6/705; H05B 6/6447
USPC ..... 219/702, 704, 705, 708, 709, 710
See application file for complete search history.

(56) References Cited

U.S. PATENT DOCUMENTS

| | | | | |
|---|---|---|---|---|
| 4,210,795 | A | 7/1980 | Lentz | |
| 4,507,530 | A | 3/1985 | Smith | |
| 6,242,726 | B1 * | 6/2001 | Harris et al. | 219/764 |
| 2010/0051612 | A1 * | 3/2010 | Fagrell et al. | 219/748 |

FOREIGN PATENT DOCUMENTS

| | | | |
|---|---|---|---|
| EP | 2326141 | A1 | 5/2011 |
| FR | 2766272 | A1 | 1/1999 |
| WO | 0008897 | A2 | 2/2000 |

OTHER PUBLICATIONS

European Search Report for Corresponding EP 12158106.0, Jun. 29, 2012.

* cited by examiner

*Primary Examiner* — Dana Ross
*Assistant Examiner* — Lindsey C Teaters

(57) ABSTRACT

A microwave heating apparatus and a method of heating a load using microwaves is disclosed. The microwave heating apparatus comprises a cavity arranged to receive a load, a microwave generator, a transmission line arranged to transmit the generated microwaves to the cavity and a sensing device arranged to measure electromagnetic field strengths at different positions along the transmission line. The positions are selected such that the measured field strengths provide information about the phase of a reflection coefficient being representative of the ratio between the amount of microwaves reflected back towards the microwave generator and the amount of microwaves transmitted in the transmission line from the microwave generator. The microwave heating apparatus further comprises a control unit configured to control feeding of the microwaves to the cavity based on the measured field strengths.

15 Claims, 4 Drawing Sheets

MICROWAVE HEATING APPARATUS

TECHNICAL FIELD

The present invention relates to the field of microwave heating, and in particular to a method and a microwave heating apparatus for heating a load by means of microwaves.

BACKGROUND

Microwave ovens usually comprise a cooking chamber (or cavity) in which a load, such as a food item, is placed to be heated, a microwave generator for generating microwaves and a transmission line for transmitting the microwaves to the cavity. A common problem associated with prior art microwave ovens is that the heating provided by the microwaves is not always suitable for the particular food item placed in the cavity. For example, the heating may result in hot and cold regions in the food item, leaving the user with the choice of accepting that some regions of the food item are not heated properly or continuing the heating process and thereby running the risk of burning parts of the food item.

A possibility to overcome the above-mentioned problem is to equip the microwave oven with sensors for monitoring the cavity and the load in order to determine how to heat the load. However, such sensors do not provide sufficient information about the load to provide efficient heating. Infrared sensors for example may be used to monitor the surface of the load, but provide little or no information about the interior of the load, its cooking state or its total weight.

Thus it would be desirable to provide a microwave heating apparatus and a method for heating a load by means of microwaves with an alternative way of monitoring the load in order to improve the efficiency of the heating process.

SUMMARY

An object of at least some of the embodiments of the present invention is to provide a microwave heating apparatus and a corresponding method for heating a load using microwaves, with an alternative way of monitoring the load and which provides improved efficiency of the heating process.

This and further objects of the present invention are achieved by means of a microwave heating apparatus and a method having the features defined in the independent claims. Preferable embodiments of the invention are characterized by the dependent claims.

According to a first aspect of the present invention, there is provided a microwave heating apparatus comprising a cavity arranged to receive a load, a microwave generator arranged to generate microwaves, a transmission line arranged to transmit the generated microwaves to the cavity and a sensing device arranged to measure electromagnetic field strengths at different positions along the transmission line. The positions are selected such that the measured field strengths provide information about the phase of a reflection coefficient being representative of the ratio between the amount of microwaves reflected back towards the microwave generator and the amount of microwaves transmitted in the transmission line from the microwave generator. The microwave heating apparatus further comprises a control unit configured to control feeding of the microwaves to the cavity based on the measured field strengths.

According to a second aspect of the present invention, there is provided a method for heating a load arranged in a cavity using microwaves fed from a microwave generator via a transmission line. The method comprises the step of measuring electromagnetic field strengths at different positions along the transmission line, the positions being selected such that the measured field strengths provide information about the phase of a reflection coefficient being representative of the ratio between the amount of microwaves reflected back towards the microwave generator and the amount of microwaves transmitted in the transmission line from the microwave generator. The method further comprises the step of controlling the feeding of the microwaves to the cavity based on the measured field strengths.

The present invention makes use of an understanding that measurements of electromagnetic field strengths at positions along the transmission line may provide information about the phase of a reflection coefficient being representative of the ratio between the amount of microwaves reflected back towards the microwave generator and the amount of microwaves transmitted in the transmission line from the microwave generator, and that the feeding of microwaves to the cavity may be controlled based on the measured field strengths, i.e. based on information about the phase of the reflection coefficient.

The present invention is advantageous in that it provides a microwave heating apparatus for which the measured electromagnetic field strengths provide information about the phase of the reflection coefficient. Information about the phase of the reflection coefficient may be used to distinguish between food items of different size or weight, or to identify different states of the load (or change in state of the load), such as when a frozen food item has been defrosted. With information about the phase of the reflection coefficient the feeding of microwaves to the cavity may be adapted to provide a more suitable heating of the load, thereby improving the efficiency of the heating, possibly saving time and/or energy.

Information about the phase of the reflection coefficient provides a possibility of distinguishing between loads (or objects) or state (status) of loads which are difficult to distinguish in other ways. Monitoring of the load and control of the microwave heating apparatus may be performed by measuring the amount of microwaves absorbed by the load, e.g. via measurement of the amount of microwaves reflected back, the control being thereby based on the amplitude of the reflection coefficient. Although such control may sometimes be satisfactory, there may be food items which are very different in many aspects but still tend to absorb similar amounts of microwaves, making them difficult to distinguish using only the amplitude of the reflection coefficient. While different food items may represent the same amount of load, and thereby result in similar amplitudes for the reflection coefficient, such food items may require different heating programs and thus different control of the microwave heating apparatus. The present invention provides a microwave heating apparatus and a method considering the phase of the reflection coefficient, which is particularly useful to detect changes in the state of the load. For example, the phase of the reflection coefficient tends to change dramatically when a food item changes state from frozen to thawed.

Another advantage of the present invention is that the measurements involved may be easily performed with standard detectors or simple detection arrangements, e.g., involving a few components such as diodes and capacitors at each of the positions along the transmission line at which measurements are to be performed. Hence, although the present invention may also be implemented with e.g. directional couplers (or an arrangement of directional couplers) or more advanced and large bulky equipment, there is no need for such arrangements. Moreover, measurements only need to be performed at a few positions along the transmission line. Therefore, various parts of the sensing device (or measuring equipment) may be arranged at a few fixed positions along the transmission line and do not need to be moved to perform the measurements, which eliminates, or at least reduces, the need for moving parts or for an equipment adapted to measure along entire sections of the transmission line.

The microwave heating apparatus of the present invention is preferably a microwave oven, but may also be a larger microwave heating apparatus for industrial appliances or a microwave heating apparatus for use in automatic vending machines.

The cavity may preferably be rectangular, with e.g. several rectangular parts, but may also be cylindrical or have any other shape suitable for using microwaves for heating.

The microwave generator may be of any suitable type, such as e.g. a magnetron or a solid state microwave generator. The microwave heating apparatus may comprise several microwave generators of one type, or of several different types. If there are several microwave generators, there may be several transmission lines and the sensing device may be arranged to measure field strengths along several transmission lines. The microwave heating apparatus may therefore include several sensing devices arranged to measure field strengths along different transmission lines.

The sensing devise may comprise detectors or other measuring equipment arranged at positions along the transmission line. The sensing device may comprise a unit for collecting the measurements and the sensing device may comprise a processor for processing the measurements. The sensing devise may even be an integrated part of the control unit.

The electromagnetic field strengths measured by the sensing device may be electric field strengths and/or voltages.

The reflection coefficient carries information about the total load of the microwave heating apparatus (seen or experienced by the microwave generator), i.e. the transmission line, the coupling of the transmission line to the cavity (i.e. a feeding port), the cavity with its interior (e.g. the walls of the cavity), and the load, such as food items. Microwaves generated by the microwave generator may be transmitted in the transmission line to the cavity. The transmission line, the coupling to the cavity, the cavity with its interior, and the load, such as food items, may not absorb all the transmitted microwaves, thereby resulting in an amount of microwaves reflected back towards the microwave generator. The transmitted microwaves and the reflected microwaves may be represented by complex numbers. The ratio between these two numbers may be represented by a reflection coefficient, which is also a complex number. The influence of the part of the total load represented by or caused by the transmission line, the coupling to the cavity and the cavity itself on the reflection coefficient may be more or less constant. However, the load placed in the cavity (e.g. a food item) may vary with time under the effect of microwaves, thereby causing a variation of the reflection coefficient. Therefore, the reflection coefficient may be used to obtain information about the particular part of the total load constituted by food items placed in the cavity, often referred to simply as the load in the following.

The control unit may comprise a processor for processing the measured field strengths. The control unit may control the feeding of microwaves to the cavity based directly on the measured electromagnetic field strengths, or it may control the feeding based on information extracted from the measured field strengths. The control unit may comprise a memory in which a number of different feeding instructions may be stored and from which the control unit may choose a suitable feeding instruction based on the measured field strengths. The control unit may control the feeding of microwaves to the cavity by selecting different parameters associated with the feeding. The control unit may be a separate unit or an integrated part of the sensing device.

The transmission line may be at least one of a coaxial structure (such as a coaxial cable), a waveguide, a microstrip and a stripline. The microwave apparatus may include several transmission lines, among which some are of one type and some are of another.

The sensing device may include a direct current rectifying device, preferably including diodes, which is advantageous in that the alternating signals obtained from the electromagnetic fields in the transmission line may be converted to direct current voltages representing the electromagnetic field strengths.

According to an embodiment of the present invention, the microwave heating apparatus may further comprise a processor (or processing means) configured to extract the phase of the reflection coefficient using the measured field strengths. According to this embodiment, the control unit may be configured to control the feeding of the microwaves to the cavity based on the extracted phase.

As previously described, the phase of the reflection coefficient provides information about the load which may be difficult to obtain in other ways. The phase may for example be used to identify the size and/or the weight of food items (the load arranged on the cavity) and/or to distinguish between different states of the load. Monitoring of the phase of the reflection coefficient is particularly useful for determining a change in state such as when a frozen food item becomes defrosted.

The control unit may then control the feeding of microwaves to the cavity (directly) based on the extracted phase. For example, the extracted phase may be compared with reference values of phases corresponding to reference loads for a particular setting of the operating parameters of the microwave apparatus, and a feeding of microwaves suitable for the most similar reference load may be selected. As a result, a more efficient heating of the load may be provided.

According to an embodiment of the present invention, the processor (or processing means) may be further configured to extract the amplitude of the reflection coefficient using the measured field strengths, and the control unit may be configured to control the feeding of the microwaves to the cavity based on the extracted amplitude.

As previously described, the reflection coefficient as defined above carries information about the load. Although the phase (itself) of the reflection coefficient may be used to determine properties of the load, extracting or identifying both the phase and the amplitude of the reflection coefficient provides more detailed information, thereby further improving the control of the feeding. Further, if for some food items the phases of the reflection coefficients are similar or if no significant variation of the phase is observed for a food item, then the control of the feeding may be based on the amplitude. Analogously, if instead the amplitudes are similar, the control of the feeding may be based on the phase. The phase and amplitude may also be used in combination to represent the reflection coefficient as a complex number and/or as a point in a two-dimensional coordinate system. In this coordinate system, distances (using any suitable metric, e.g. ordinary Euclidean distance) between points may be used to measure the difference between reflection coefficients. Using such distances may be a suitable alternative, compared to focusing on differences in phase and amplitude separately, since it takes both of these parameters into account.

According to another embodiment of the present invention, the microwave heating apparatus may further comprise a processor (or processing means) configured to extract, using (or from) the measured field strengths, a complex impedance experienced by the microwave generator. In the present embodiment, the control unit is configured to control the feeding of the microwaves to the cavity based on the extracted impedance.

When generating the microwaves, which are to be transmitted by the transmission line to the cavity in order to heat the load, the microwave generator experiences an impedance caused by the transmission line, the coupling of the transmission line to the cavity, the cavity itself and its interior, including the load (e.g. a food item). This impedance may be referred to as a complex impedance to stress the fact that it may comprise a real part (resistance) and an imaginary part (reactance). The microwave generator may be regarded as a power source connected to a circuit comprising the transmission line, the coupling to the cavity, the cavity itself and its interior, including the load. The complex impedance may then be thought of as the input impedance seen by the microwave generator. The parts of the impedance caused by the transmission line, the coupling to the cavity and the cavity itself may be more or less constant and known, while the impedance caused by the load may change depending on the particular load and/or any change in state of a particular load. Hence, the impedance experienced by the microwave generator provides information about the load which may be used to control the feeding of the microwaves to the cavity in order to provide a more suitable heating for the particular load. As a result, the heating may be faster and/or more efficient.

The complex impedance may provide more or less the same information about the load as the reflection coefficient. The complex impedance may therefore be used in a similar way as the phase and amplitude of the reflection coefficient, namely to recognise the size and/or the weight of the load or to determine the state of the load.

According to an embodiment of the present invention, the microwave heating apparatus may further comprise a storage unit arranged to store reference values of electromagnetic field strengths, phases of reflection coefficients and/or amplitudes of reflection coefficients associated to reference loads. According to the present embodiment, the microwave heating apparatus may further comprise a processor (or processing means) configured to compare the measured electromagnetic field strengths, extracted phases and/or extracted amplitudes with the stored reference values, wherein the control unit is configured to control the feeding of the microwaves to the cavity based on this comparison.

The storage unit may be a separate unit or it may be part of the sensing device, the control unit or any of the processors described in relation to the present embodiment or to any one of the preceding embodiments of the present invention.

The reference loads may be a collection of loads for which suitable feedings of microwaves to the cavity are known. Data necessary for carrying out these suitable feedings may be stored in the storage unit, in the control unit or in some other unit. When the comparison with the reference values has been made, the processor may determine which reference load is most likely to be similar to the current load. The control unit may then control the feeding of microwaves to the cavity based on the data associated with the most similar reference load. In this way, the feeding of microwaves may be adapted to the current load so as to provide a more efficient heating of the load.

The reference loads may include different reference states of a collection of loads, i.e. different reference values may be stored for the same load but in different states. The comparison made by the processor may then be used to determine the state of the load, and the feeding of the microwaves to the cavity may be controlled accordingly.

Reference values of electromagnetic field strengths associated with reference loads may be stored in the storage unit, and the measured electromagnetic field strengths may be compared with these reference values. Similarly, reference values of phases of reflection coefficients associated with reference loads may be stored in the storage unit, and an extracted phase may be compared with these reference values. Using the result of the comparison, the control unit may determine if the current load is similar to any of the reference loads. If the current load is similar to a reference load, the control unit may control the feeding of microwaves to the cavity according operating parameters associated with such a reference load and, optionally, a cooking program selected by the user.

According to an embodiment of the present invention, the sensing device may be arranged to measure the electromagnetic field strengths at four different positions spaced from each other along the transmission line. The present embodiment is advantageous in that the measurements only need to be performed at four positions, which is sufficient to provide information about the phase of the reflection coefficient, thereby reducing the complexity of the sensing device.

Preferably, the spacing between two adjacent positions may approximately be equal to $\lambda/8+n\times\lambda/2$, wherein $\lambda$ is a wavelength corresponding to the operating frequency of the microwave generator or a mid-value of wavelengths available in an operating frequency band of the microwave generator and n is a (non-negative) integer.

As will be further illustrated in the following, it may be advantageous to place the measurement positions at distances corresponding to approximately an eight of the wavelength of the generated microwaves, i.e. at a distance from each other equal to the wavelength divided by eight.

It will be appreciated that magnetrons are typically configured to generate microwaves at a single frequency, the operating frequency, corresponding to a single wavelength ($\lambda$) in the transmission line, in which case two adjacent positions for the measurements may be separated by $\lambda/8$. Other microwave generators, e.g. solid state microwave generators, may be adapted to generate microwaves at different frequencies, i.e. within an operating frequency band (or within a set of discrete frequencies), from a lower frequency to a higher frequency, corresponding to a band of wavelengths (or a set of discrete wavelengths) from a longer to a shorter wavelength in the transmission line. In this case, there is a whole range (or set) of wavelengths available at the microwave generator and the mid-value $\lambda$ may be chosen as any wavelength between the shorter and the longer wavelength or as an average value of the wavelengths available within this range. As mentioned above, the spacing between the measurement positions is preferably equal to approximately an eighth of the wavelength of the microwaves generated by the microwave generator. It will be appreciated that, although the spacing between the measurement positions is defined as a function of the wavelength or frequency of the microwaves and the frequency of the microwaves may be varied, it is possible to compensate for different operating frequencies, thereby eliminating (or at least reducing) the need of extra measurement positions or any moving parts for moving the measurement positions. Further, an operating frequency within the commonly used frequency band 2400-2500 (2450+/−50 MHz) results only in an error of about 2%, which is negligible.

The signal provided by electromagnetic field strengths measured along the transmission line is periodic with a period equal to half of the wavelength of the generated microwaves, i.e. approximately equal to half of the mid-value λ of wavelengths. Hence, it will be appreciated that the measurement positions may be translated along the transmission line by e.g. λ/2, 2×λ/2, 3×λ/2 or 4×λ/2.

Measuring field strengths at four positions separated by an approximate distance of λ/8+n×λ/2 is advantageous in that it provides sufficient information about the phase of the reflection coefficient. In particular, from such measurements, an estimate of the reflection coefficient, or the complex impedance experienced by the microwave generator, may be derived.

Preferably, the microwave heating apparatus may further comprise a processor (or processing means) configured to obtain a real part and an imaginary part of a complex impedance experienced by the microwave generator, the complex impedance being obtained using (from) the difference between the electromagnetic field strengths measured at two of the four different positions, these two positions being separated along the transmission line by approximately λ/4+n×λ/2 (λ being the wavelength of the microwaves, as defined above), and the difference between the electromagnetic field strengths measured at the remaining two positions.

The complex impedance may be illustrated as a working point in a Smith chart. In the Smith chart, the x-coordinate of this working point corresponds to the difference between the electromagnetic field strengths measured at two of the four different positions as described above, and the y-coordinate corresponds to the difference between the electromagnetic field strengths measured at the remaining two positions.

The complex impedance of the load may be derived from the working point by using the special coordinate curves of the Smith chart. The real part of the impedance may be derived by following a coordinate circle of the Smith chart from the working point to the horizontal axis, while the imaginary part of the impedance may be derived by following a coordinate curve from the working point to the outer circle of the Smith chart.

The reflection coefficient may be derived from the working point by using polar coordinates in the Smith chart. The amplitude of the reflection coefficient may be derived by measuring the distance from the working point to the centre point of the Smith chart. The phase of the reflection coefficient may be derived from the angle formed between the horizontal axis and a ray from the centre point of the Smith chart passing through the working point. The phase of the reflection coefficient may be measured in degrees (or radians) or it may be measured in fractions of λ, λ/2 corresponding to a full turn (360 degrees) in the Smith chart.

The microwave heating apparatus may further comprise a processor (or processing means) configured to extract the phase of the reflection coefficient using the real part and imaginary part of the complex impedance experienced by the microwave generator. Although a Smith chart is used to illustrate embodiments of the present invention, it will be appreciated that the processor may extract the phase and the amplitude of the reflection coefficient, or the real part and the imaginary part of the complex impedance, via other processing operations.

According to an embodiment of the present invention, the microwave generator may include a magnetron. The magnetron may be arranged to generate microwaves at a single frequency.

According to an embodiment of the present invention, the microwave generator may include a frequency-controllable microwave generator, preferably a solid state microwave generator. Frequency-controllable microwave generators may generate microwaves at different frequencies.

According to an embodiment of the present invention, the sensing device may be arranged to measure electromagnetic field strengths for different frequencies of the generated microwaves and the microwave heating apparatus may further comprise a processor (or processing means) configured to extract at least one of the phase and amplitude of the reflection coefficient for different frequencies of the generated microwaves using the measured field strengths. According to the present embodiment, the control unit may be configured to control the feeding of the microwaves to the cavity based on at least one of the extracted phase and the extracted amplitude of the reflection coefficient for different frequencies of the generated microwaves.

Measuring field strengths and extracting the phase and/or amplitude of the reflection coefficient for different frequencies is advantageous in that the operating frequency of the microwave heating apparatus may be selected based on such measurements and/or extracted values. In particular, the conditions of resonance may be detected.

The sensing device may be arranged to measure electromagnetic field strengths for a set of discrete frequencies, and the processor may be arranged to extract the phase and/or amplitude of the reflection coefficient for these discrete frequencies. Both the phase and the amplitude of the reflection coefficient may depend on the frequency, and this dependency may be used to identify different loads or states of a load (e.g. via a number of discrete working points in a Smith chart). The inventors have recognized that phases associated with smaller loads tend to change more when the frequency is changed than phases associated with larger loads. In particular, the microwave heating apparatus may be configured to monitor the ratio between a change in phase and a change in frequency, or the ratio between a change in amplitude and a change in frequency, and to use these ratios to detect different loads, different states of the load or optimal working conditions (i.e. optimal operating parameters). Other quantities, such as e.g. sums or even sums of squares of differences in phase and amplitude, may be calculated in order to recognise different loads, states of the load or optimal working conditions.

Alternatively, the sensing device may be arranged to measure electromagnetic field strengths by scanning an entire frequency band, and the processor may be arranged to extract the phase and/or amplitude of the reflection coefficient for these frequencies based on the measurements. The phase and/or amplitude may be represented as a function of the frequency, e.g. illustrated as a curve in a Smith chart.

The control unit may preferably be configured to select at least one operating frequency of the microwave generator based on at least one of the extracted phase and the extracted amplitude of the reflection coefficient for different frequencies of the generated microwaves, which is advantageous in that it provides a more efficient heating of the load. Monitoring the phase of the reflection coefficient for different frequencies is advantageous in that it enables selection of a suitable frequency or suitable frequencies for operating the microwave heating apparatus, which is not necessarily the frequency for which the amplitude of the reflection coefficient is at a minimum.

According to an embodiment of the present invention, the control unit may be configured to control feeding of the microwaves via control of parameters relating to the microwave generator and/or the transmission line. These parameters may include the frequency, phase and/or amplitude of the microwaves generated by the microwave generator (in particular for e.g. a solid state microwave generator), which is advantageous in that such parameters may be controlled rapidly and easily by electrical signals. The control of the feeding may also be performed via movable or rotatable parts involved in the feeding of microwaves to the cavity.

According to an embodiment of the present invention, the microwave heating apparatus may further comprise a processor (or processing means) configured to extract, using the measured field strengths, information comprising at least one of a size of the load, a weight of the load and a state of the load. According to the present embodiment, the control unit may be configured to control the feeding of the microwaves to the cavity based on the extracted information.

According to an embodiment of the present invention, the sensing device may be configured to measure the electromagnetic field strengths at a plurality of time instants and the control unit may be configured to control the feeding of the microwaves to the cavity based on a change (or variation), between those time instants, in the measured field strengths. A change in the measured field strengths may indicate a change in phase/amplitude of the reflection coefficient and/or a change in complex amplitude. The control unit may then be arranged to control the feeding of the microwaves to the cavity based on such a detected change. A change between time instants may mean a change between two time instants or a change occurring between more than two time instants at which measurements are performed. Such changes may be illustrated by graphs such as Smith charts. A change in the measured field strengths may indicate a change in the state of the load and thus that the heating of the load needs to be changed or stopped.

According to an embodiment of the present invention, the microwave heating apparatus may further comprise a processor (or processing means) configured to identify a change in state of the load based on the measured field strengths as a function of time or as a function of load temperature. According to the present embodiment, the control unit may be configured to control the feeding of the microwaves to the cavity based on the identified change in state.

The state of the load may be a critical parameter for determining how to feed microwaves to the cavity for optimal heating of the load or even for determining if the heating process is to be stopped. The present invention is advantageous in that the measured field strengths provide information about the phase of the reflection coefficient. Indeed, for example when defrosting a frozen food item, the amplitude of the reflection coefficient may not vary when the food item has reached a thawed state while the phase may vary significantly. The present embodiment is advantageous in that it enhances the identification of a change in state of the load and that the feeding of the microwaves to the cavity may be adapted accordingly.

It should be noted that the processors or processing means described above in relation to the embodiments of the present invention may be integrated in a single processor adapted to process the measured electromagnetic field strengths in accordance with any one or any combination of the preceding embodiments. The processors may also be separate units, and/or at least some of the processors may be integrated with each other. At least some of the processors may be integrated parts of the sensing device, the control unit or even the storage unit.

It will be appreciated that the use of Smith charts to derive or extract the phase and/or amplitude of the reflection coefficient and/or the impedance of the load, merely serves as an example for illustrative purposes. The use of Smith charts may preferably be replaced by the use of corresponding mathematical equations known in the art, which are better suited for computations.

It will be appreciated that any of the features in the embodiments described above for the microwave heating apparatus according to the first aspect of the present invention may be combined with the embodiments of the method according to the second aspect of the present invention. Further objectives of, features of, and advantages with, the present invention will become apparent when studying the following detailed disclosure, the drawings and the appended claims. Those skilled in the art will realize that different features of the present invention can be combined to create embodiments other than those described in the following.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION

Figure 1:
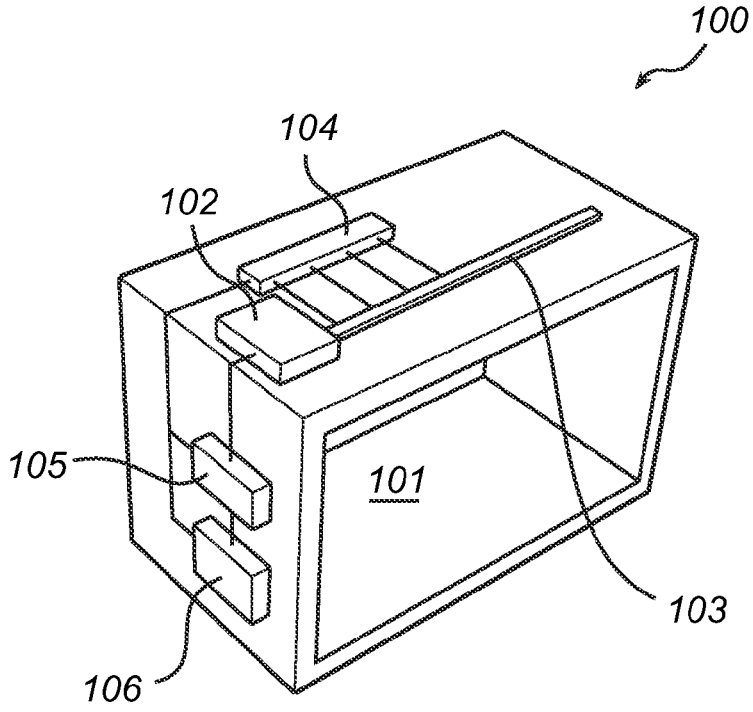
FIG. 1 is a schematic view of a microwave heating apparatus according to an embodiment of the present invention.
Figure 2:
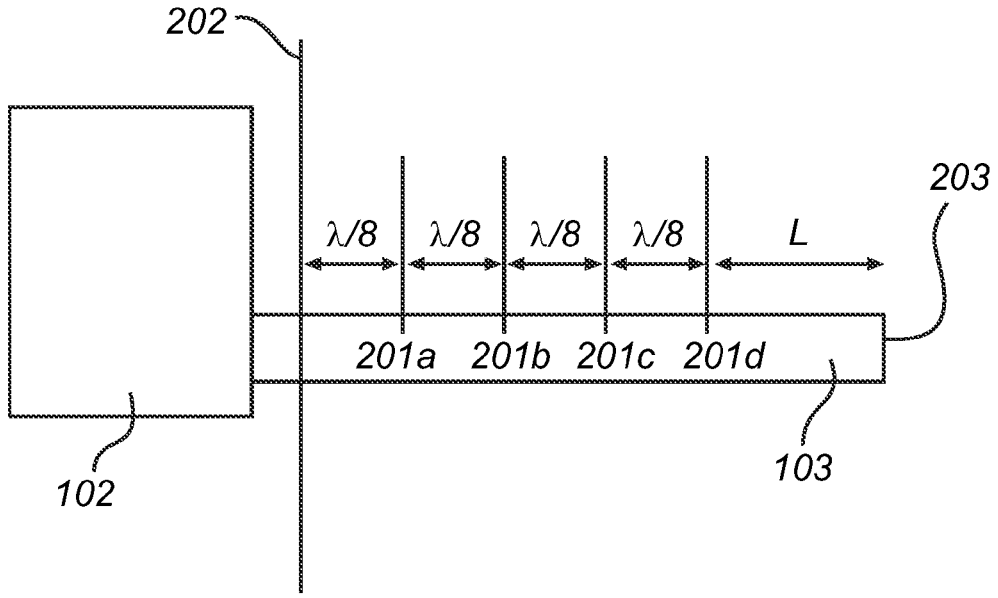
FIG. 2 schematically shows a sensing device according to an embodiment of the present invention.

With reference to FIGS. 1 and 2, the microwave heating apparatus 100 comprises a cavity 101 arranged to receive a load, a microwave generator 102 arranged to generate microwaves, a transmission line 103 arranged to transmit the generated microwaves to the cavity 101 via e.g. a feeding port or an antenna (not shown in the figures but which may be arranged at any walls of the cavity, at e.g. an extremity of the transmission line) and a sensing device 104 arranged to measure electromagnetic field strengths at different positions 201*a-d* along the transmission line 103. The positions 201*a-d* are selected such that the measured field strengths provide information about the phase of a reflection coefficient being representative of the ratio between the amount of microwaves reflected back towards the microwave generator 102 and the amount of microwaves transmitted in the transmission line 103 from the microwave generator 102. The microwave heating apparatus 100 further comprises a control unit 105 configured to control feeding of the microwaves to the cavity 101 based on the measured field strengths.

In the present embodiment, the microwave heating apparatus 100 may be a microwave oven. In the present embodiment, the cavity 101 is designed to have the shape of a rectangular parallelepiped for illustrative purposes only, with a width of 470 mm, a depth of 400 mm and a height of 400 mm. It will be appreciated that the present invention is not limited to such a shape or size. The cavity 101 may have many different shapes, such as a polyhedron, a cylinder, a sphere, etc. or combinations thereof.

In the present embodiment, the microwave generator 102 may be a solid state microwave generator, which is configured to generate microwaves at different frequencies, e.g. in the range 2400 to 2500 MHz. However, the microwave generator 102 may also be a magnetron. The microwave heating apparatus 100 may comprise several microwave generators of one type or of several different types. If there are several microwave generators, the microwave heating apparatus 100 may include several transmission lines and the sensing device 104 may be arranged to measure field strengths along several transmission lines. Each of the different transmission lines may be equipped with its own sensing device.

The microwave generator 102 may be arranged at the outside of a wall of the cavity 101 and connected to the cavity 101 via a transmission line 103. The transmission line 103 may, e.g., be arranged to transmit the generated microwaves to enter the cavity 101 from above at a central position in the roof of the cavity 101.

According to the present embodiment, the sensing device 104 is arranged to measure electromagnetic field strengths at four positions 201*a-d* along the transmission line 103. The spacing between two adjacent positions is approximately equal to $\lambda/8$, wherein $\lambda$ is a mid-value of wavelengths available in the operating frequency band of the microwave generator 102. As the available frequencies are between 2400 MHz and 2500 MHz, the mid-value of wavelengths may be, e.g., the wavelength corresponding to microwaves generated at a frequency of 2450 MHz.

According to the present embodiment, a first position 201*a*, among the four measurement positions 201*a-d*, is located along the transmission line 103 at a distance $\lambda/8$ from a reference plane 202, in the direction away from the microwave generator 102. A second position 201*b*, among the four measurement positions 201*a-d*, is located along the transmission line 103 at a distance $\lambda/8$ from the first position 201*a* in the direction away from the microwave generator 102. Similarly, a third position 201*c* is located along the transmission line 103 at a distance $\lambda/8$ from the second position 201*b* in the direction away from the microwave generator 102, and a fourth position 201*d* is located along the transmission line 103 at a distance $\lambda/8$ from the third position 201*c* in the direction away from the microwave generator 102.

The electromagnetic field strengths measured along the transmission line 103 originate from the microwaves generated by the microwave generator 102. The field strengths tend to be periodic with a periodicity being double that of the wavelength of the transmitted microwaves, i.e. periodic with approximately the period $\lambda/2$. Therefore, the positions 201*a-d* at which the field strengths are measured may in general be translated along the transmission line 103 by e.g. $\lambda/2$, $2\times\lambda/2$, $3\times\lambda/2$ or $4\times\lambda/2$ without significantly affecting the results of the measurements.

According to the present embodiment, the microwave heating apparatus 100 further comprises a processor 106 configured to extract the phase and/or amplitude of the reflection coefficient.

The reflection coefficient may be represented as a working point in a Smith impedance chart, having a Cartesian coordinate system with x-coordinates and y-coordinates. The x-coordinate of the working point may be derived by subtracting the field strength measured at the second position 201*b* from the field strength measured at the fourth position 201*d*, and possibly compensating for various scaling or damping effects. For example, there may be damping between the sensing device 104 and the transmission line 103. The damping may be arranged by standard methods to provide suitable insulation of e.g., 20 dB or 30 dB. The y-coordinate of the working point in the Smith chart may be derived by subtracting the field strength measured at the first position 201*a* from the field strength measured at the third position 201*c*, and compensating for various scaling or damping effects.

The amplitude of the reflection coefficient may be derived by measuring the distance from the working point to the centre point of the Smith chart. The phase of the reflection coefficient may be derived from the angle formed between the horizontal axis and a ray from the centre point of the Smith chart passing through the working point. The phase of the reflection coefficient may be measured in degrees (or radians) or it may be measured in fractions of $\lambda$, $\lambda/2$ corresponding to a full turn (360 degrees) in the Smith chart.

The present approach, using the Smith chart, is an alternative with which the processor 106 may extract the phase and/or the amplitude of the reflection coefficient. However, the present invention is not limited to such an approach and other alternatives may be envisaged.

The Smith chart may be used to associate the reflection coefficient with a complex impedance experienced by the microwave generator 102. This complex impedance may be derived by using the special coordinates of the Smith impedance charts relating to the real part and the imaginary part of the complex impedance. The real part of the complex impedance may be derived by following a coordinate circle of the Smith chart from the working point to the horizontal axis, while the imaginary part of the complex impedance may be derived by following a coordinate curve from the working point to the outer circle of the Smith chart.

Figure 3:
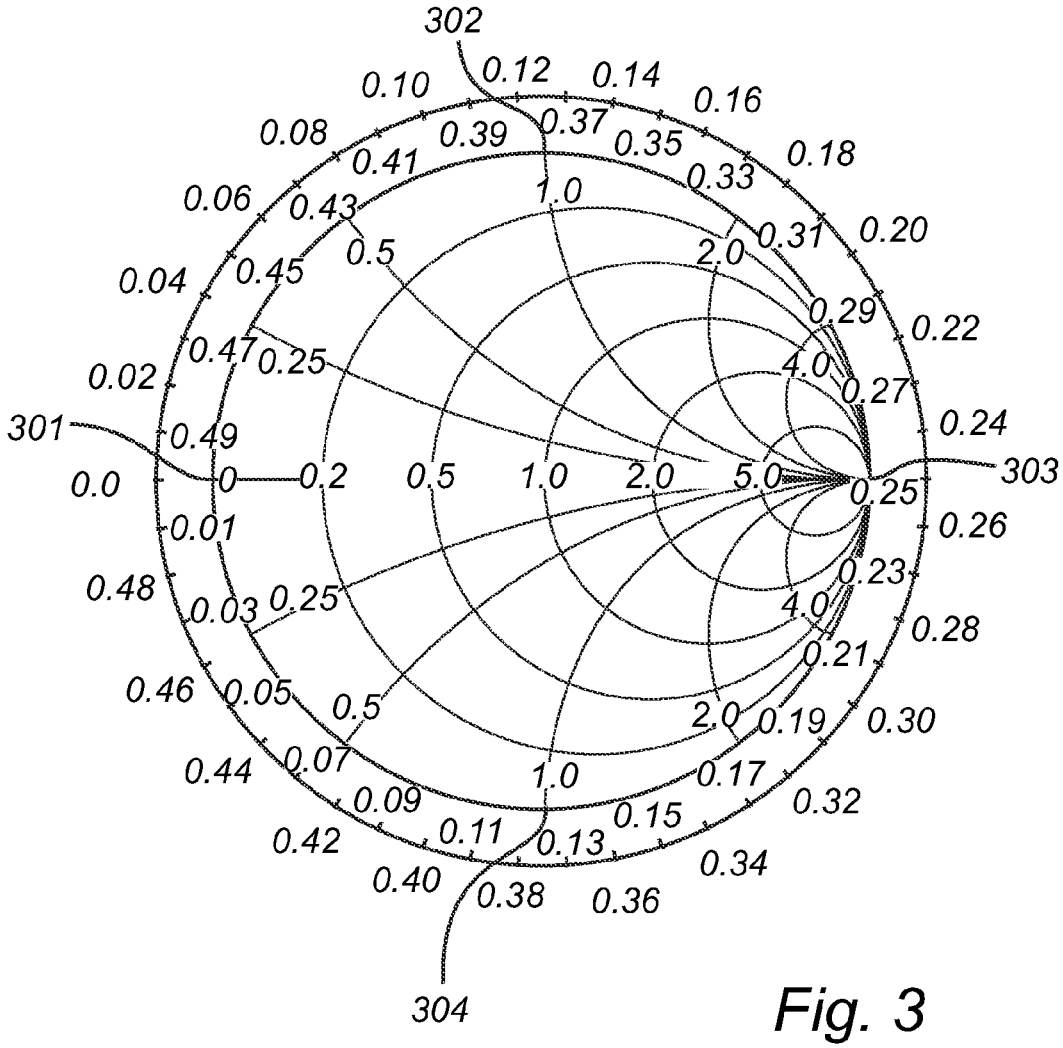
FIG. 3 schematically shows a Smith impedance chart illustrating measurements made according to an embodiment of the present invention.

FIG. 3 schematically shows a Smith impedance chart illustrating example measurements made according to the present embodiment. Referring to FIG. 2 and FIG. 3, the leftmost point 301 of the Smith chart represents a short circuit 203 introduced at the fourth position 201*d* (L=0). If a short circuit 203 is introduced at the end of the transmission line 103, at a distance $L=\lambda/8$ from the fourth position 201*d*, in the direction away from the microwave generator 102, this corresponds to the uppermost point 302 in the Smith chart since this is a distance $\lambda/8$ away from the fourth point 201*d*, i.e. ¼ turn going clock-wise around the Smith chart from the leftmost point 301 corresponding to the fourth point 201*d*.

By increasing the distance L, between the short circuit 203 and the fourth position 201*d*, in the direction away from the microwave generator 102, in steps of $\frac{1}{8}\lambda$, the corresponding position in the Smith chart is moved/rotated from the uppermost point 302, to the rightmost point 303, to the lowermost point 304 and back to the leftmost point 301. Such an arrangement provides conditions, shown in Table 1, for the x-coordinate and y-coordinate of a point representing these positions in the Smith chart, and the measured field strengths at the measurement positions 201*a-d*. In Table 1, the field strengths measured at the four positions 201*a-d* are denoted by $Y_1$. $X_2$, $Y_3$, and $X_4$ respectively.

TABLE 1

Conditions for coordinates in the Smith chart and measured field strengths

| L | Point | 201a | 201b | 201c | 201d | x-coordinate | y-coordinate |
|---|---|---|---|---|---|---|---|
| 1/8 λ | 302 | 0 | $=X_4$ | | $=X_2$ | $=X_4-X_2=0$ | $=Y_3-Y_1=Y_3$ |
| 2 × 1/8 λ | 303 | $=Y_3$ | 0 | $=Y_1$ | | $=X_4-X_2=X_4$ | $=Y_3-Y_1=0$ |
| 3 × 1/8 λ | 304 | | $=X_4$ | 0 | $=X_2$ | $=X_4-X_2=0$ | $=Y_3-Y_1=-Y_1$ |
| 4 × 1/8 λ | 301 | $=Y_3$ | | $=Y_1$ | 0 | $=X_4-X_2=-X_2$ | $=Y_3-Y_1=0$ |

Figure 4:
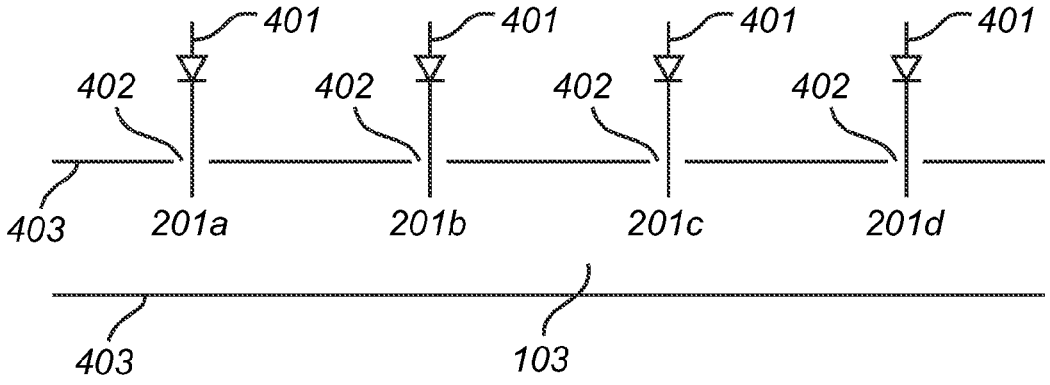
FIG. 4 schematically shows a transmission line of a microwave heating apparatus according to an embodiment of the present invention.

FIG. 4 schematically shows a transmission line 103 of a microwave heating apparatus 100 according to an embodiment of the present invention. In this embodiment, the transmission line 103 is a coaxial cable from which diodes 401 are picking up signals through small holes 402 in the outer conductor 403. In order not to obscure the figure, the inner conductor of the coaxial cable is not shown in FIG. 4.

Figure 5A:
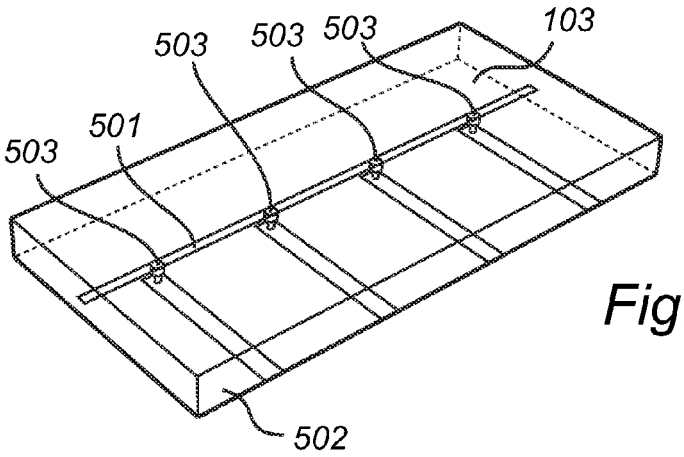
FIGS. 5*a-b* schematically show a transmission line of a microwave heating apparatus according to an embodiment of the present invention.
Figure 5B:
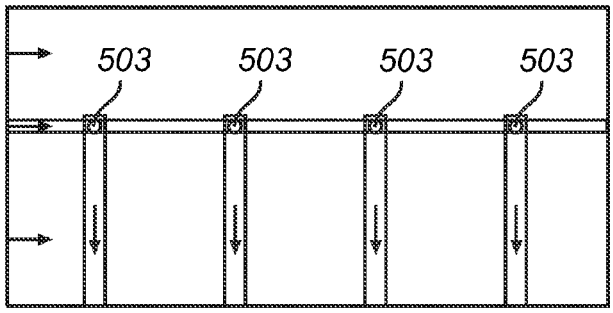

FIG. 5*a* is a schematic perspective view of a transmission line 103 of a microwave heating apparatus 100 according to an embodiment of the present invention, and FIG. 5*b* is a schematic top-view of this transmission line 103 in which arrows indicate the direction of signals. In this embodiment, the transmission line 103 is a microstrip with a conductor 501 and a ground plane 502. Electromagnetic field strengths are measured using signal outputs via holes 503 in the ground plane 502.

The reflection coefficient and the associated (complex) impedance for a given load depend on the frequency of the generated microwaves. By monitoring the amplitude (ρ) and/or the phase (ϕ) of the reflection coefficient for different frequencies (f), one may derive the variation in the phase (Δϕ) and/or amplitude (Δρ) caused by the variation in frequency (Δf). These values may be used to form the ratios Δϕ/Δf and Δρ/Δf, which may be useful for characterizing the load. Other quantities such as, e.g., $$\frac{\sqrt{(\Delta\rho)^2+(\Delta\varphi)^2}}{\Delta f}$$

may also be formed to characterize the load.

FIGS. 6*a-d* schematically show impedance charts on which examples of reflection coefficients as a function of frequency (or for different frequencies) are represented. The frequencies in these examples start at 2440 Mz, corresponding to points 602 in the figures. As the frequency increases, the reflection coefficients form curves in the impedance charts. The frequencies end at 2470 Mz corresponding to points 601 in the figures.

Figure 6A:
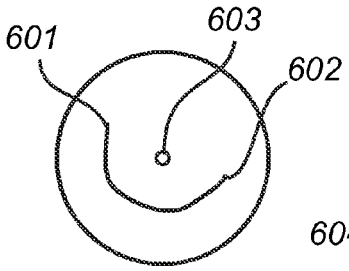
FIGS. 6*a-d* schematically show impedance charts with examples of complex impedances extracted for different frequencies (or as a function of frequency)

FIG. 6*a* illustrates an unfavourable complex impedance with a longline effect. The distance from the curve to the centre 603 of the chart represents a large value for the amplitude (ρ) of the reflection coefficient, with no significant variation, indicating that none of the frequencies are particularly suitable for heating the load. The chart also shows a relatively high value for the ratio Δϕ/Δf.

Figure 6B:
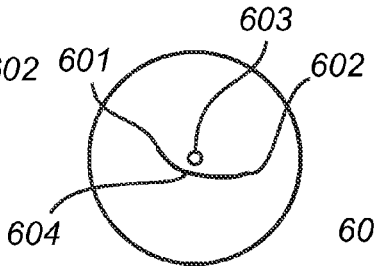

FIG. 6*b* illustrates a complex impedance with relatively high value of the ratio Δϕ/Δf, and at the same time a moderate value of the ratio Δρ/Δf. However, the chart shows that there is a point 604 for which the value of the amplitude is small, which may indicate a frequency suitable for heating the load.

Figure 6C:
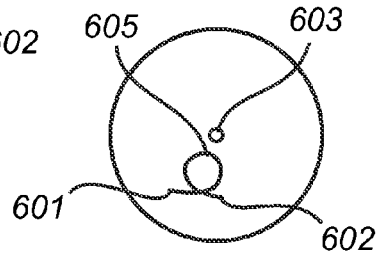

FIG. 6*c* illustrates a complex impedance with one resonant frequency at a point 605, i.e. with a good coupling to a specific mode field inside the cavity 101. At the resonant frequency the amount of microwaves reflected back towards the microwave generator is low, thereby resulting in a particularly suitable heating of the load. In this example, the ratio Δϕ/Δf is rather small while the ratio Δρ/Δf is rather large.

Figure 6D:
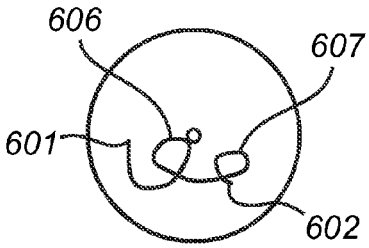

FIG. 6*d* illustrates a complex impedance with two resonant frequencies, indicated by points 606 and 607, i.e. with a good coupling to one specific mode field for each frequency. The ratio Δϕ/Δf is moderate large, and the ratio Δρ/Δf is large when considered for the entire frequency band. However, the ratio Δϕ/Δf is small around each resonance frequency if the condition is imposed that the amplitude of the reflection coefficient is to be smaller than a selected limit. Such characteristics opens up the feature of controlling the microwave generator 102 between two operating frequencies (jumping between the frequency corresponding to the point 606 and the frequency corresponding to the point 607). By switching between these two frequencies, the microwave heating apparatus 100 may be switched between different modes to achieve a more even heating of the load.

Figure 7:
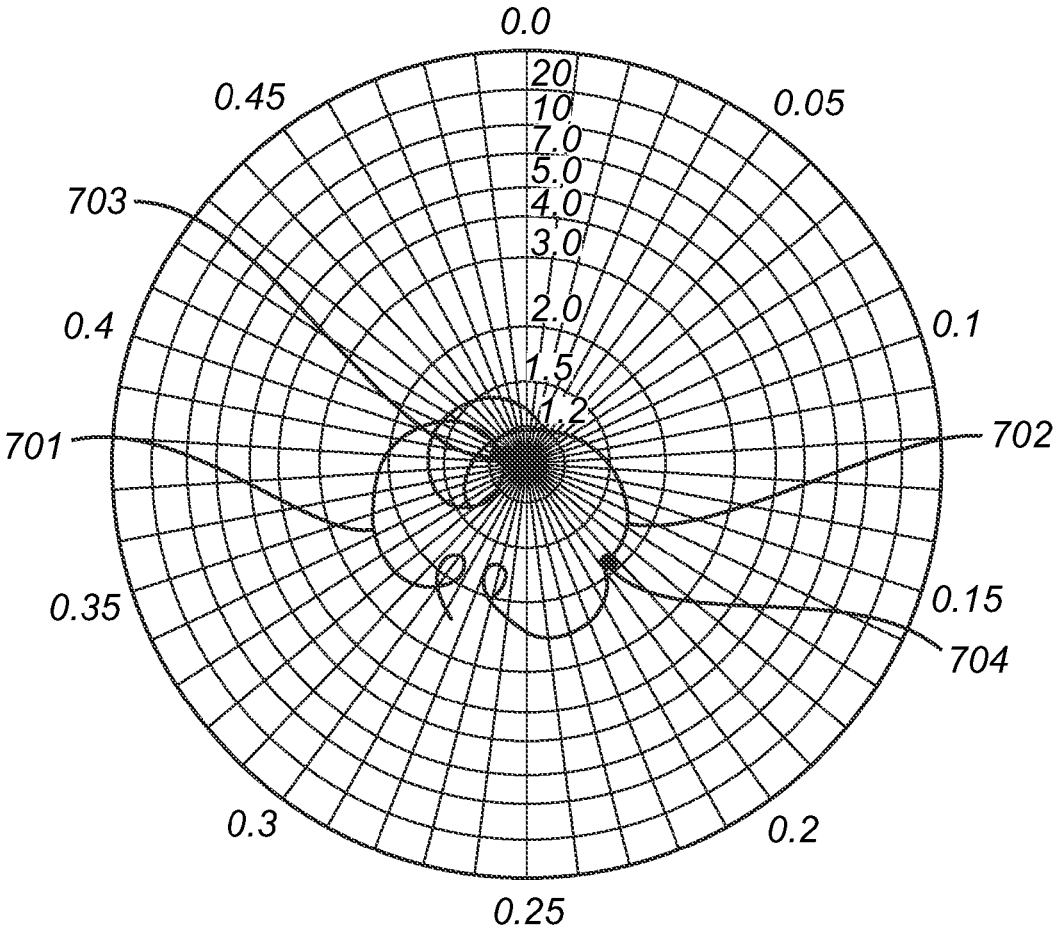
FIG. 7 schematically shows an impedance chart with an example of complex impedances as functions of frequency.

FIG. 7 schematically shows an impedance chart with examples of complex impedances as functions of frequency for the same food item in two different states, namely frozen and thawed. A frozen food item may have an impedance as a function of frequency as indicated by a first curve 701 in FIG. 7. When the food item is approaching the freezing/thawing point, the latent zone, a dramatic change in impedance will appear, in which the impedance changes towards a second curve 702. This change can easily be detected, especially by considering the change of phase of the reflection coefficient. When the change has been detected, defrosting may be stopped without delay or the heating may be adapted to the new state of the load by changing the feeding of microwaves to the cavity.

If the microwave generator 102 is a magnetron, only one frequency may be available. In that case, only one point 703 in the first impedance curve 701 and one point 704 in the second impedance curve 702 will be available. In some cases, this may still be sufficient to detect the change of state of the load.

Consider the example of comparing a large load, e.g. 1000 g of food, with a small load, e.g. popcorn or a small amount of frozen food. The two loads could have identical reflection coefficients for a specific frequency, but the phase shift (between different frequencies) would be much larger for the small load. The present example illustrates that identifying the phase of the reflection coefficient provides information about the load, which may further improve the heating.

According to an embodiment of the present invention, the control unit 105 is arranged to control the feeding of microwaves based on the extracted phase and amplitude. Such control may be performed in accordance with any of the abovementioned examples. For example, by monitoring the phase and/or amplitude of the reflection coefficient for different frequencies, resonant frequencies may be found which are particularly suitable for heating the load. The control unit 105 may control the microwave generator 102 to generate microwaves at such frequencies to improve the efficiency of the heating. For example, the heating may be faster and/or more energy efficient.

The control may also be based on phase and amplitude extracted at different time instants. By considering changes in phase and/or amplitude as a function of time or load temperature, changes in state, such as thawing, of food items may be identified. The control unit 105 may be configured to change the feeding of microwaves to the cavity 101 when such a change is identified.

A storage unit may be integrated in the processor 106. The storage unit may contain reference values of phases and/or amplitudes of reflection coefficients corresponding to reference loads, and data necessary for carrying out feeding of microwaves suitable for these reference loads. The processor 106 may compare the phase and/or amplitude corresponding to the load in the cavity 101 with the reference phases and/or amplitudes and the control unit 105 may control the feeding of microwaves according to the result of this comparison, using the feeding data stored in the storage unit.

Figure 8:
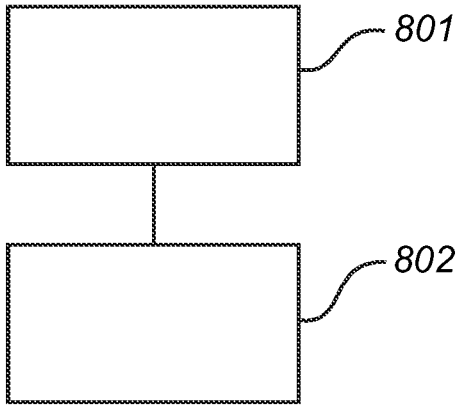
FIG. 8 is a general outline of a method of heating a load using microwaves in accordance with an embodiment of the present invention.

With reference to FIG. 8, a method for heating a load arranged in a cavity using microwaves fed from a microwave generator via a transmission line is described in accordance with an embodiment of the present invention. The same reference numbers as for the features of the microwave heating apparatus described with reference to FIGS. 1 and 2 are used in the following. The method comprises the step of measuring 801 electromagnetic field strengths at different positions 201*a-d* along the transmission line 103. The positions 201*a-d* are selected such that the measured field strengths provide information about the phase of a reflection coefficient being representative of the ratio between the amount of microwaves reflected back towards the microwave generator 102 and the amount of microwaves transmitted in the transmission line 103 from the microwave generator 102. The method further comprises the step of controlling 802 the feeding of the microwaves to the cavity 101.

It will be appreciated that any one of the embodiments described above with reference to FIGS. 1-7 is combinable and applicable to the method described herein with reference to FIG. 8.

The present invention is applicable for domestic appliances such as a microwave oven using microwaves for heating. The present invention is also applicable for heating in industrial appliances. The present invention is also applicable for vending machines or any other dedicated applications.

While specific embodiments have been described, the skilled person will understand that various modifications and alterations are conceivable within the scope as defined in the appended claims. For example, at least some of the processors, control units and sensing devices mentioned above may be separate units or may be integrated parts of a single unit.

It will be appreciated that the positions (along the transmission line) at which the electromagnetic field strengths are measured may preferably be selected such that the measured field strengths are usable for extraction of the phase of the reflection coefficient with a good accuracy. Accuracy of the phase of the reflection coefficient may depend on the positions at which the measurements are made and the accuracy of the actual values recorded during these measurements.

What is claimed is:

1. A microwave heating apparatus comprising:

a cavity arranged to receive a load;

a microwave generator arranged to generate microwaves to heat the load;

a transmission line arranged to transmit the generated microwaves to the cavity;

a sensing device arranged to measure electromagnetic field strengths at four different positions along the transmission line, wherein the spacing between two adjacent position is approximately equal to $\lambda/8+n\times\lambda/2$, wherein $\lambda$ is a wavelength corresponding to the operating frequency of the microwave generator or a mid-value of wavelengths available in a operating frequency band of said microwave generator and n is an integer, and wherein the measured field strengths at all four positions provide information about the phase of a reflection coefficient being representative of the ratio between the amount of microwaves reflected back towards the microwave generator and the amount of microwaves transmitted in the transmission line from the microwave generator and measured field strengths at the two adjacent positions provide information on complex impedance experienced at the microwave generator; and a control unit configured to control the frequencies of the microwaves to the cavity based on the reflection coefficient and the complex impedance.

2. The microwave heating apparatus according to claim 1, further comprising a processor configured to extract the phase of the reflection coefficient using the measured field strengths, wherein the control unit is configured to control the frequencies of the microwaves to the cavity based on the extracted phase.

3. The microwave heating apparatus according to claim 2, wherein the processor is further configured to extract the amplitude of the reflection coefficient using the measured field strengths, wherein the control unit is configured to control the frequencies of the microwaves to the cavity based on the extracted amplitude.

4. The microwave heating apparatus according to claim 1, further comprising a processor configured to extract, using the measured field strengths, a complex impedance experienced by the microwave generator, wherein the control unit is configured to control the frequencies of the microwaves to the cavity based on the extracted impedance.

5. The microwave heating apparatus according to claim 1, further comprising a storage unit arranged to store reference values of at least one of electromagnetic field strengths, phases of reflection coefficients or amplitudes of reflection coefficients associated to reference loads, and a processor configured to compare at least one of the measured electromagnetic field strengths, extracted phases or extracted amplitudes with the stored reference values, wherein the control unit is configured to control the frequencies of the microwaves to the cavity based on said comparison.

6. The microwave heating apparatus according to claim 1, further comprising a processor configured to obtain a real part and an imaginary part of a complex impedance experienced by the microwave generator, said complex impedance being obtained using the difference between the electromagnetic field strengths measured at two of said four different positions, said two positions being separated along the transmission line by approximately $\lambda/4+n\times\lambda/2$, and the difference between the electromagnetic field strengths measured at the two remaining positions.

7. The microwave heating apparatus according to claim 1, wherein the microwave generator includes multiple magnetrons, each at a different frequency.

8. The microwave heating apparatus according to claim 1, wherein the microwave generator includes a solid state microwave generator.

9. The microwave heating apparatus according to claim 8, wherein the sensing device is arranged to measure electromagnetic field strengths for different frequencies of the generated microwaves, the microwave heating apparatus further comprising a processor configured to extract at least one of the phase or amplitude of the reflection coefficient for different frequencies of the generated microwaves using the measured field strengths, wherein the control unit is configured to control the frequencies of the microwaves to the cavity based on at least one of the extracted phase and the extracted amplitude of the reflection coefficient for different frequencies of the generated microwaves.

10. The microwave heating apparatus according to claim 9, wherein the control unit is configured to select at least one operating frequency of the microwave generator based on at least one of the extracted phase and the extracted amplitude of the reflection coefficient for different frequencies of the generated microwaves.

11. The microwave heating apparatus according to claim 1, wherein the control unit is configured to control feeding of the microwaves via control of parameters relating to at least one of the microwave generator or the transmission line.

12. The microwave heating apparatus according to claim 1, further comprising a processor configured to extract, using the measured field strengths, information comprising at least one of a size of the load, a weight of the load and a state of the load, wherein the control unit is configured to control the frequencies of the microwaves to the cavity based on the extracted information.

13. The microwave heating apparatus according to claim 1, wherein the sensing device is configured to measure the electromagnetic field strengths at a plurality of time instants, wherein the control unit is configured to control the feeding of the microwaves to the cavity based on a change, between said time instants, in the measured field strengths.

14. The microwave heating apparatus according to claim 1, further comprising a processor configured to identify a change in state of the load based on the measured field strengths as a function of time or as a function of load temperature, wherein the control unit is configured to control the frequencies of the microwaves to the cavity based on the identified change in state.

15. A method for heating a load arranged in a cavity using microwaves fed from a microwave generator via a transmission line, the method comprising the steps of:

measuring electromagnetic field strengths at four different positions along the transmission line, wherein the spacing between two adjacent position is approximately equal to $\lambda/8+n\times\lambda/2$, wherein $\lambda$ is a wavelength corresponding to the operating frequency of the microwave generator or a mid-value of wavelengths available in a operating frequency band of said microwave generator and n is an integer, and wherein the measured field strengths at all for positions provide information about the phase of a reflection coefficient being representative of the ratio between the amount of microwaves reflected back towards the microwave generator and the amount of microwaves transmitted in the transmission line from the microwave generator and measured field strengths at the two adjacent positions provide information on complex impedance experienced at the microwave generator; and controlling the frequencies of the microwaves to the cavity based on the reflection coefficient and the complex impedance.

* * * * *